United States Patent [19]

Selzer

[11] 3,996,437

[45] Dec. 7, 1976

[54] VACUUM CONTACTOR FOR MOTOR CONTROL AND METHOD OF MAKING

[75] Inventor: Amos Selzer, Glendale, Wis.

[73] Assignee: Cutler-Hammer, Inc., Milwaukee, Wis.

[22] Filed: Dec. 3, 1973

[21] Appl. No.: 421,099

[52] U.S. Cl. ..... 200/144 B; 92/47; 200/83 C; 92/34

[51] Int. Cl.[2] ..... H01H 33/66

[58] Field of Search ..... 200/144 B, 83 B, 83 C; 92/47, 45, 34

[56] References Cited

UNITED STATES PATENTS

| | | | |
|---|---|---|---|
| 2,027,836 | 1/1936 | Rankin et al. | 200/144 B |
| 3,082,307 | 3/1963 | Greenwood et al. | 200/144 B |
| 3,087,034 | 4/1963 | Beers et al. | 200/144 B |
| 3,231,704 | 1/1966 | Jacobs | 200/144 B |
| 3,430,015 | 2/1969 | Crouch et al. | 200/144 B |
| 3,485,978 | 12/1969 | Grindell | 200/144 B |
| 3,508,021 | 4/1970 | Bellis | 200/144 B |
| 3,668,350 | 6/1972 | Takeuchi et al. | 200/144 B |
| 3,683,138 | 8/1972 | Nabae et al. | 200/144 B |
| 3,700,842 | 10/1972 | Attia | 200/144 B |
| 3,727,018 | 4/1973 | Wesoloski et al. | 200/144 B |
| 3,861,277 | 1/1975 | Wagner et al. | 200/83 C |

*Primary Examiner*—Robert S. Macon
*Attorney, Agent, or Firm*—Hugh R. Rather; William A. Autio; Michael E. Taken

[57] ABSTRACT

A vacuum contactor for motor control applications and method of making the same that produces a switch of minimum size and extremely long mechanical life. This method comprises the step of heating the vacuum assembly to not over 450° C during the evacuation process thereby allowing use of welded diaphragm bellows having the attendant advantages of much smaller size and longer life for a given length of stroke as compared to formed bellows. Because the operating conditions for motor control applications do not require as high voltage and current breakdown levels and thus the residual gas level inside the vacuum contactor enclosure need not be as low as in the case of circuit breaker (interrupter) applications, limiting the heating to not over 450° C allows use of AM-350 stainless steel welded diaphragm bellows without sacrificing its required mechanical life. Furthermore, the bellows shield is designed to achieve minimum current chopping and at the same time maintain high current interruption capabilities. Two types of vacuum switch configurations made according to this method are disclosed.

19 Claims, 3 Drawing Figures

VACUUM CONTACTOR FOR MOTOR CONTROL AND METHOD OF MAKING

BACKGROUND OF THE INVENTION

The reason why vacuum contactors and vacuum interrupters are used for power switching applications is due to two fundamental properties of the vacuum medium.

First, the dielectric strength of a vacuum gap is far superior to any other switching medium (air in atmospheric pressure, oil, etc.). These properties enable the construction of small sized lightweight practical switching devices.

The tendency of the vacuum arc to cease to exist at low current (known as current chopping), a condition that exists every half cycle in alternating current systems, reduces the scope of application of vacuum switches to systems with low surge impedances (low inductive systems).

The stability of the vacuum arc depends only on the amount of metal vapor present in the gap between the contacts of the vacuum switch at arcing time. The metal vapor is supplied by the contact material. One way to increase the stability of the vacuum arc and reduce the current chopping level is to choose contact material with high vapor pressure. This choice has its limitations because a material with high vapor pressure tends to erode faster and it also might raise the pressure inside the vacuum switch and reduce the interruption capabilities of the device. The other way is to try to prevent the vapor from diffusing into the volume of the switch for a short period of time. This will increase the stability of the vacuum arc and at the same time would not reduce the interruption ability of the vacuum switch. My invention addresses itself to the latter choice. Vacuum means any pressure lower than the standard atmospheric pressure of 760 mm Hg.

Vacuum contactors for motor control applications have been known heretofore.

The vacuum contactor differs from the vacuum interrupter in that its lower voltage rating makes it possible to use a smaller volume. Also, the vacuum contactor has to repeat its function many more times than does the vacuum interrupter.

The requirement for repetitive operation calls for a bellows with a long life.

SUMMARY OF THE INVENTION

This invention relates to vacuum contactors and methods of making the same.

An object of the invention is to provide an improved vacuum contactor.

Another object of the invention is to provide an improved method of making a vacuum contactor.

A more specific object of the invention is to provide an improved vacuum contactor having a long life for motor control applications.

Another specific object of the invention is to provide an improved method of making a vacuum contactor allowing the use of welded diaphragm bellows therein of long life material and small size without sacrificing the long life thereof required for motor control applications.

Other objects and advantages of the invention will hereinafter appear.

DESCRIPTION OF THE PREFERRED EMBODIMENTS

Figure 1:
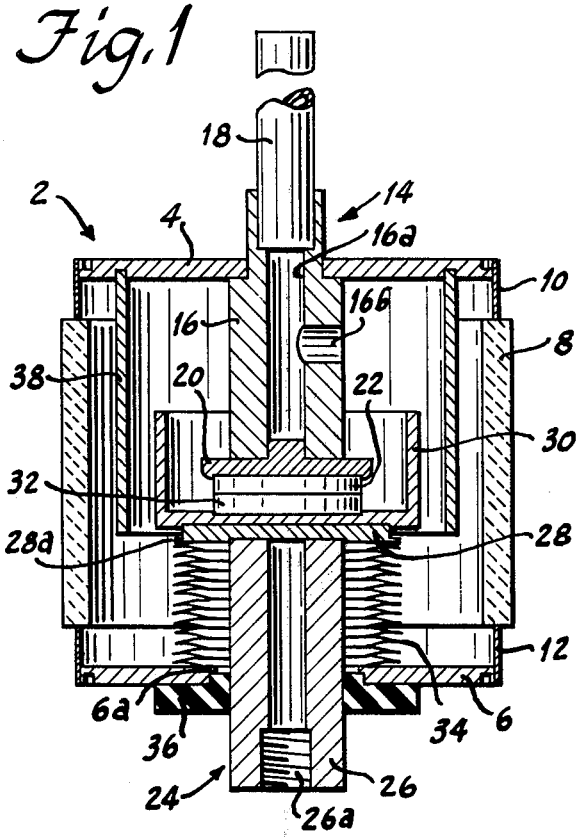
FIG. 1 is a cross-sectional view along the vertical axis of a first configuration of vacuum contactor designed for 100–200 ampere current range devices.

Referring to FIG. 1, there is shown a first configuration of vacuum contactor particularly adapted for the lower current applications such as 100–200 amperes for reasons hereinafter appearing.

This vacuum contactor is generally cylindrical in form and is provided with a hermetically sealed, vacuum enclosure called a vacuum "bottle" that includes a ceramic insulator section, a stationary contact, a movable contact sealed by a bellows, and shields within the enclosure.

This enclosure 2 comprises an upper plate 4 and a lower plate 6 both being circular "disc" shaped with a center hole and preferably composed of stainless steel, and being connected at their peripheral portions by an electrically insulating tube or cylinder. This insulating tube has an insulating center section 8 connected by an upper metal section or ring 10 to upper plate 2 and connected by a lower metal section or ring 12 to lower plate 6.

As will be apparent, center section 8 is required to insulate the two contacts from one another. For this purpose, this center section is made of electrically insulating material such as glass, alumina ceramic, or the like and hermetically sealed and secured to upper ring 10 and lower ring 12.

Rings 10 and 12 are preferably copper tubing that is nickel plated prior to brazing to the upper and lower plates to form a hermetic seal therebetween.

Stationary contact 14 is assembled from a number of parts. A stationary stem 16 is the main supporting member for the stationary contact. It is composed of copper and has a reduced diameter upper end portion extending up through the round center hole in upper plate 4 so that the plate fits closely around the stem and against the shoulder of the latter, and the two parts are brazed together to form a hermetic seal therebetween.

This stem 16 is provided with a bore 16a therethrough having an enlarged diameter at its upper end into which an air evacuation tube 18 is inserted and brazed to form a hermetic seal. A hole 16b extends from this bore radially through the wall thereof to provide a passage for evacuating air from the enclosure when a pump is connected to tube 18. Tube 18 may be copper and is pinched to close it after the required amount of air has been pumped out.

To complete the stationary contact, a coined contact holder 20 is provided for securing a contact 22 to the lower end of the stem. This coined contact holder is provided with a short stub extending up from its center into the bore in stem 16 and is brazed to the stem to form a hermetic seal therebetween. Coined contact 22 is brazed to the lower surface of the contact holder.

Movable contact assembly 24 is assembled from a number of parts. A movable stem 26 is the main supporting member for the movable contact. It is composed of copper and has a bore therethrough with the lower end of this bore being tapped to provide a thread 26a to afford securing of a contact operating member thereto. A stainless steel bellows plate 28 is brazed to the upper end of movable stem 26 to close the bore therein with a hermetic seal. A cup-shaped bellows shield 30 rests on top of bellows plate 28 and is brazed thereto. A butt type movable contact 32 is brazed to the bottom within this cup-shaped bellows shield. The cylindrical sides of this bellows shield extend up around the stationary contact, contact holder and the lower end portion of the stationary stem. The distance between the cylindrical inner wall and the contact holder surface parallel to it is optimized to achieve minimum current chopping and maximum current interruption. The height of the cylindrical wall depends on the maximum opening gap between the contacts. It varies between one-half the gap length to six times gap length.

A welded diaphragm bellows 34 hermetically seals the movable contact to the enclosure while allowing the movable contact to be actuated to open and close the contacts. For this purpose, the upper end of the bellows is welded to the lower surface periphery of bellows plate 28. As shown in FIG. 1, the periphery of the lower surface of this bellows plate is provided with a reduced thickness flange 28*a* to facilitate welding the upper end of the welded bellows thereto in a hermetic sealing manner. Also, the lower end of the welded bellows is welded to the rim of the central hole in lower plate 6. The upper surface around this hole is provided with a reduced thickness rim 6*a* to facilitate welding the lower end of the bellows thereto in a hermetic sealing manner.

To provide a guide for axial movement of movable contact stem 26, a bushing 36 comprised of white molding material or the like is secured to lower plate 6 with epoxy or the like. This bushing has a short projection extending up into the hole in lower plate 6 against the reduced thickness rim around movable stem 26 to fill the space therebetween while guiding the movable stem and allowing it to be moved up and down therein.

A stainless steel shield 38 of cylindrical form is secured at its upper end into a round groove in the lower surface of upper plate 4. This shield is suspended between cup-shaped bellows shield 30 and insulating cylinder 8, about half-way therebetween, and extends down to about the bottom of bellows shield 30. This shield 38 shields the arcing products from ceramic cylinder 8 and provides a metal surface for the gases to condense on.

Bellows shield 30 shields the arcing products from the bellows and the overlap of the two shields increases the distance so as to keep the hot metallic vapor and particles away from the bellows. Another function of this shield is to maintain higher pressure close to the contacts. This will lower the current chopping level. Another function of this shield is to provide surface area for the purpose of collecting ions and condensing gases in order to improve the interruption capabilities of the device.

Figure 2:
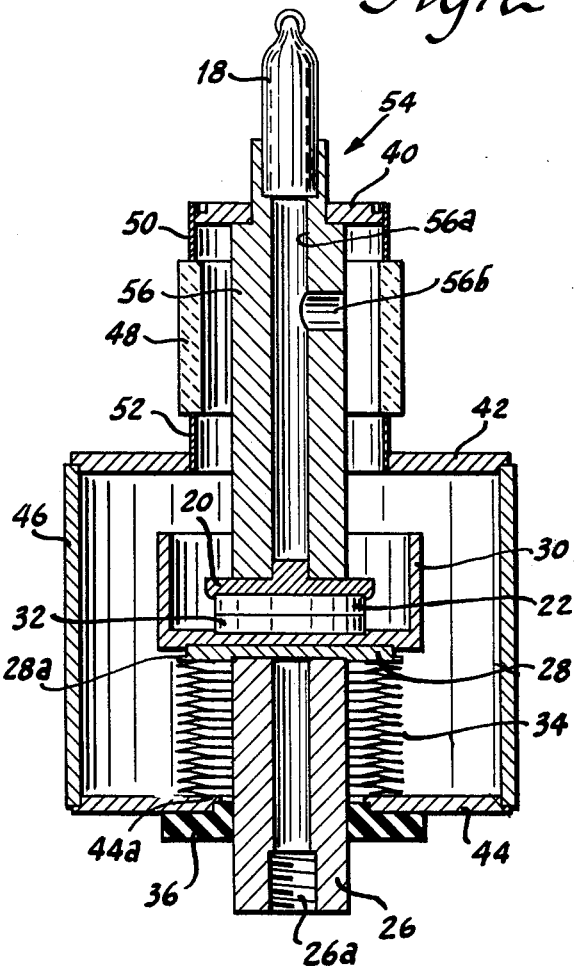
FIG. 2 is a cross-sectional view along the vertical axis of a second configuration of vacuum contactor designed for higher current range devices such as 200–600 amperes.

FIG. 2 shows a second configuration of vacuum contactor particularly adapted for higher current motor control applications such as 200–600 amperes for reasons hereinafter appearing. As is readily apparent in FIG. 2, this configuration is arranged to reduce to a minimum the amount of electrically insulating ceramic material used which is costly while affording a sufficient volume within the enclosure for the voltage rating of the vacuum contactor.

Typical voltage ratings for these vacuum contactors are 2.3 kilovolts and 4.16 kilovolts R.M.S. The 2.3 kv contactor must have an insulating ceramic that will withstand at least 10 kv while the 4.16 kv contactor must have an insulating member that will withstand at least 20 kv. This invention involves making these costly insulating members as small diameter and as short as possible consistent with the voltage withstanding requirements. The FIG. 1 configuration appears to be practical and economical for the lower current devices such as 100–200 amperes because at this current rating the ceramic insulator size is not prohibitive and it has one less part than does the FIG. 2 configuration. The FIG. 2 configuration appears to be practical and economical for the higher current devices such as 200–600 amperes because it decreases the ceramic size to a minimum while affording sufficient volume although it has one more part than the FIG. 1 configuration as will hereinafter appear.

In FIG. 2, reference characters like those in FIG. 1 are used for like parts.

As shown in FIG. 2, the insulating ceramic cylinder is placed in the reduced diameter upper section of the enclosure to provide effective insulation while maintaining sufficient volume.

The hermetically sealed enclosure is provided with three plates including an upper plate 40, a middle plate 42 and a lower plate 44, these plates being composed of stainless steel and each being provided with a central hole. The insulating cylinder or tube connects the peripheral portion of upper plate 40 to the rim of the hole in middle plate 42 to provide the aforesaid reduced diameter upper section of the enclosure. A stainless steel cylinder or tube 46 connects the peripheral portions of middle plate 42 and lower plate 44 to provide the large diameter lower section of the enclosure.

This insulating tube has an insulating center section 48 and copper rings 50 and 52 secured to opposite ends thereof in a hermetically sealed manner. Upper ring 50 is connected with a hermetic seal to the periphery of upper plate 40 and lower ring 52 is connected with a hermetic seal to the rim of the hole in middle plate 42. This insulating tube is like that shown in FIG. 1 except shorter and of smaller diameter.

Stationary contact 54 is generally similar to that in FIG. 1 except that its stationary stem 56 is longer so as to extend through the reduced diameter upper section of the enclosure into the larger diameter lower section thereof. This stem has a similar bore 56*a* and side hole 56*b* and is similarly mounted and sealed into the central hole in upper plate 40. Tube 18 is secured in the enlarged bore in the upper end of stem 56 and contact holder 20 and contact 22 are secured to the lower end of this stem, all as in the FIG. 1 configuration.

The movable contact assembly in FIG. 2 is similar to that in FIG. 1 including stem 26 and threaded bore 26*a* therein, bellows plate 28, bellows shield 30, movable contact 32 and welded diaphragm bellows 34. The only difference is that lower plate 44 has a slightly different peripheral configuration to accommodate stainless steel cylinder 46. The lower end of the bellows is welded to the reduced thickness rim 44*a* around the hole in the lower plate. And bushing 36 is cemented with epoxy in place to guide stem 26 as described in connection with the first configuration shown in FIG. 1.

As will be apparent, this FIG. 2 configuration does not require a shield like shield 38 of FIG. 1 since ceramic tube 48 is located in the reduced diameter upper section of the enclosure and, thus, is not in direct line with the arcing products leaving the contacts.

Although the FIG. 2 configuration has one more part than the FIG. 1 configuration, differing in an additional plate 42 and metal cylinder 46 as against shield 38 of FIG. 1, nevertheless it is more efficiently and economically adapted to the higher current applications of 200–600 amperes because of the reduced diameter insulating ceramic 48 while providing sufficient volume of vacuum with the large diameter metal cylinder 46 for its voltage rating.

Characteristics that are desired in a vacuum contactor for motor control application are minimum size of insulator, long life bellows and capability of assembly under 500° C.

While 10,000 operations might be sufficient for vacuum breakers for transmission line interruption, motor control vacuum contactors require a longer life of the order of a million operations or more.

While a formed bellows provides a long life such as 50,000 operations or more despite the heating to high temperature such as 800° C required for proper evacuation of transmission line vacuum interrupters, to get sufficient contact movement the formed bellows becomes prohibitively large. For example, for a given deflection, a formed bellows must be about 6 times as high, for example 2¼ inches as compared to ⅜ inch for a welded diaphragm bellows. However, a welded diaphragm bellows loses its life when heated to 800° C so that formed bellows have generally been used in vacuum interrupters and vacuum contactors.

The ceramic insulator is the big cost item in a vacuum contactor. To minimize this cost, the invention provides two configurations of vacuum contactors that are optimum for low current and high current ranges of motor control applications, respectively. While the ceramic is larger in FIG. 1, nevertheless, it is not so large as to be extremely costly for the 100–200 ampere range device. While the FIG. 2 configuration has one more part, nevertheless it has a smaller ceramic to optimize it for the 200–600 ampere range devices.

The invention provides a method of making these vacuum contactors that avoids having to bake them above 450° C, thereby enabling use of an extremely long life welded diaphragm bellows of AM-350 stainless steel, or the like.

| FIG. 1 Configuration | FIG. 2 Configuration |
|---|---|
| a. Braze the stationary stem, evacuation tube, contact holder contact, upper plate and suspended shield together at five joints in vacuum or other inert gas environment. | a. Same, except four joints |
| b. Braze the movable stem, bellows plate, bellows shield and contact together at three joints in vacuum or other inert gas environment | b. Same |
| c. Weld the bellows to the bellows plate and lower plate (TIG* weld or electron beam) *Tungsten inert gas. | c. Same |
| | d. Weld (TIG weld or electron beam) the lower (insulator) ring to the middle plate and the middle plate to the stainless steel cylinder |
| e. Weld (TIG weld or electron beam) the lower plate to the envelope (lower insulator ring) | e. Same, except envelope is stainless steel cylinder. |
| f. Weld (TIG weld or electron beam) upper plate to envelope (upper insulator ring) | f. Same, except middle plate to envelope (stainless steel cylinder) |
| g. Bake the device 2–12 hours having the inside in the pressure range of $10^{-2}$ to $10^{-8}$ torr* and the outside in vacuum or other inert gas environment at temperatures up to 450 degrees C. *1 torr = 1 mm Hg | g. Same |
| h. Clinch the evacuation tube | h. Same |
| i. Put mechanical protection on the sealed area. | i. Same |

The key to using welded diaphragm bellows is the above method and the fact that for motor control applications the residual gas level inside the bottle does not have to be as low as for circuit interrupter applications. This is because vacuum contactors for motor control are in the rating range of 1.1 to 7.5 kv and 100–900 amperes whereas circuit interrupters for transmission line use are capable of interrupting 15 kv and 31,000 amperes.

Assembling the parts in accordance with the above methods does not require heating the complete assembly or the bellows at any time to temperatures above 450° C.

While bonding of metal to ceramic or glass requires higher temperatures such as 780° C, the insulating tube that includes the ceramic cylinder and the metal rings at the opposite ends thereof is made beforehand and then used as one of the integral parts in the above assembly method.

Limiting the heating to the aforesaid low temperature allows use of welded diaphragm bellows made from stainless steel AM-350, 347 or the like.

This affords the advantage of very short bellows, about one-sixth of the length of equivalently deflecting formed bellows of a given diameter, resulting in a reduced size of vacuum contactor. Another advantage gained therefrom is increase in mechanical life up to millions of operations, this being attained with the use of conventional stroke lengths of 0.06 to 1.5 inches.

With respect to the configuration shown in FIG. 2, a certain volume is necessary to achieve power interruption. This volume depends upon many variables including pressure, contact material, rating of power interruption, geometry of contacts, etc. This configuration affords the required volume within the enclosure without overly increasing the amount of material going into the ceramic insulator. Thus, the volume needed to maintain the pressure low, below $10^{-4}$ torr, is provided by the large metallic portion of the enclosure while using the minimum diameter of ceramic.

The length of the insulator is determined by the voltage rating of the vacuum contactor. The two contacts are electrically separated by the alumina ceramic or glass insulator. Each inch length of the insulator surface can withstand about 10 kv in air. Thus, the insulator of a device that is rated 20 kv can be as short as two inches, etc. But within the vacuum, below $10^{-4}$ torr, the distance between two metallic parts of different potential can be made much shorter, such as 0.06 to 1 inch, without breakdown or electrical leakage. This configuration of FIG. 2 uses these properties to attain the smallest insulator and smallest vacuum contactor. This configuration also omits the suspended shield of FIG. 1 and provides a large metallic surface for the gases to condense on to improve the interruption capabilities of the device.

Figure 3:
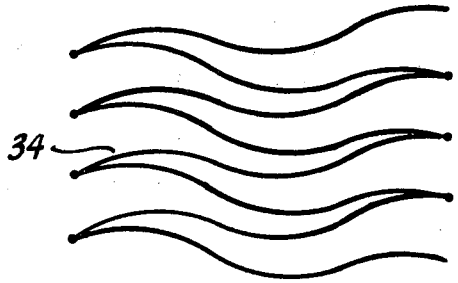
FIG. 3 is an enlarged fragmentary sectional view through one side of the welded diaphragm bellows of the vacuum contactors of FIG. 1 and 2.

FIG. 3 shows a cross-section through one side of the welded diaphragm bellows. As is apparent therein, the bellows is made from a plurality of stacked flexible washer-shaped elements having like annular curvatures formed therein to enhance their flexure. Each such element is welded around its inner edge to the element directly above it and is welded around its outer edge to the element directly below it so as to close the inner space from the outside with a hermetic seal.

While the apparatus and method hereinbefore described is effectively adapted to fulfill the objects stated, it is to be understood that the invention is not intended to be confined to the particular preferred embodiments of vacuum contactors for motor control and methods of making disclosed, inasmuch as they are susceptible of various modifications without departing from the scope of the appended claims.

I claim:

1. A method of making a vacuum contactor from a plurality of prepared parts including an enclosure comprising a pair of spaced apart apertured plates and an envelope comprising an electrical insulator for closing the space between the plates and insulating them from one another, a stationary contact support having a contact portion at one end thereof and adapted to be mounted in the aperture in one of said plates so as to extend into the enclosure, a movable contact support having a contact portion at one end thereof and adapted to extend freely through the aperture in the other plate for engaging the stationary contact, a welded diaphragm bellows adapted to seal the space between the movable contact support and said other plate, and means comprising an evacuation tube providing access into the enclosure to remove air therefrom comprising the steps:

a braze said stationary contact support within said aperture in said one plate to provide a hermetic seal therebetween;

weld the bellows to the movable contact support and to said other plate to seal the space therebetween while allowing resilient movement of the movable contact support in the aperture in said other plate;

weld the envelope to the two spaced plates to provide a hermetic seal therebetween and to hermetically seal the enclosure except for the evacuation tube;

bake the vacuum contactor at a temperature up to 450° C while maintaining the inside of the enclosure at a predetermined vacuum by drawing air through said evacuation tube and maintaining the outside thereof in an inert gas environment;

and after a predetermined time of baking close the evacuation tube to completely seal the contacts on the inside from the external atmosphere.

2. The invention defined in claim 1, wherein said predetermined time for baking is two to twelve hours.

3. The invention defined in claim 1, wherein said predetermined vacuum at which the inside of said enclosure is maintained is a pressure range of $10^{-2}$ to $10^{-8}$ torr.

4. The invention defined in claim 1, wherein said brazing steps comprise:

maintained a vacuum or inert gas environment for said brazing operations while they are being performed.

5. The invention defined in claim 1, wherein said welding steps comprise use of a TIG weld or electron beam welding process.

6. A method of making a vacuum contactor from a plurality of performed parts including an enclosure comprising an upper apertured plate and a lower apertured plate spaced therefrom and an envelope having an electrical insulating section for closing the space between the plates and insulating them from one another, a stationary contact structure including a contact supporting stem and a contact adapted to be secured in the aperture in the upper plate, a movable contact structure including a contact supporting stem and a bellows plate and a bellows shield and a contact adapted to extend freely through the aperture in the lower plate for engaging the stationary contact, a welded diaphragm bellows adapted to seal the comprising an evacuation tube providing access into the enclosure for removing air therefrom comprising the steps:

braze the stationary contact to its supporting stem and the latter in the aperture in the upper plate to provide a hermetic seal therebetween;

braze the bellows plate to the movable contact supporting stem, the bellows shield to the bellows plate and the movable contact to the bellows shield stacked in that order;

weld the bellows to the bellows plate and to the lower plate to provide a hermetic seal therebetween;

weld the envelope to the peripheral parts of the upper and lower plates to hermetically seal the enclosure except for the evacuation tube;

bake the vacuum contactor 2–12 hours at a temperature up to 450° C while maintaining the inside of the enclosure at a pressure range of $10^{-2}$ to $10^{-8}$ torr and the outside thereof in vacuum or inert gas environment;

and close the evacuation tube to completely seal the inside of the enclosure from the atmosphere.

7. The invention defined in claim 6, wherein said brazing steps comprise maintaining the work area in a vacuum or inert gas environment while being brazed.

8. The invention defined in claim 6, wherein said welding steps comprise use of a TIG weld or electron beam welding process.

9. A vacuum contactor for motor control applications comprising:

an evacuated enclosure including a pair of spaced apertured circular plates and an insulating envelope connected and sealed to the peripheral edges of said plates to enclose the space therebetween;

a stationary contact extending through the aperture in one of said plates and sealed to the rim of said aperture;

a movable contact extending through the aperture in the other plate for engaging the stationary contact;

means guiding said movable contact for axial movement in said other plate aperture;

a short cylindrical welded diaphragm bellows composed of long mechanical operation life material connected and sealed between said movable contact and said other plate to allow relative movement while sealing the enclosure, said welded diaphragm bellows affording a much greater contact opening stroke for its size to provide a minimum size of contactor having a very long life for motor control applications.

10. The invention defined in claim 9, wherein said long mechanical operation life material in said welded diaphragm bellows is AM 350 stainless steel.

11. The invention defined in claim 9, wherein said insulated envelope comprises:

a cylindrical member having a central section of ceramic material for electrically insulating the stationary and movable contacts from one another and having opposite end rings sealed to said ceramic section and welded to the peripheral edges of said plates.

12. The invention defined in claim 9, wherein said insulated envelope comprises:

a third apertured circular plate spaced between said one plate and said other plate;

a cylindrical member having a central electrically insulating ceramic section and opposite end rings sealed to said ceramic section and connected to the peripheral edge of said one plate and the rim of the aperture in said third plate;

and a metal cylinder connected between the peripheral edges of said other plate and said third plate.

13. The invention defined in claim 12, wherein:

said insulating cylindrical member has a relatively small diameter and serves to insulate the contacts from one another;

and said metal cylinder has a relatively large diameter and serves to condense the arc products so as to keep them away from the insulating cylinder.

14. The invention defined in claim 9, wherein said movable contact comprises:

a metal bellows shield extending from the movable contact around the adjacent end portion of the stationary contact to shield the bellows from the arc products.

15. The invention defined in claim 14, wherein said enclosure comprises:

a cylindrical metal shield secured to said one plate and suspended therefrom between said insulating envelope and said bellows shield to shield the arc products from said insulating envelope.

16. The invention defined in claim 14, wherein said metal bellows shield comprises:

a metal member having an inner wall spaced from the nearest point of the stationary contact an optimum distance to achieve minimum current chopping and maximum current interruption.

17. The invention defined in claim 16, wherein:

said inner wall of said metal bellows shield member is provided with a height generally parallel to said stationary contact that is a function of the maximum opening gap between said contacts.

18. The invention defined in claim 17, wherein:

said inner wall is provided with a height in the range of one-half to six times the length of said opening gap.

19. The invention defined in claim 16, wherein:

said inner wall is spaced from said nearest point of the stationary contact one-half to six times the length of said opening gap.

* * * * *